US006508526B2

(12) United States Patent
Reppas et al.

(10) Patent No.: US 6,508,526 B2
(45) Date of Patent: Jan. 21, 2003

(54) CONVERTIBLE BED WITH COMPUTER DESK

(75) Inventors: George S. Reppas, 1030 San Raymundo Rd., Hillsborough, CA (US) 94010; Frederick Stengel, Redwood City, CA (US)

(73) Assignee: George S. Reppas, Hillsborough, CA (US)

( * ) Notice: Subject to any disclaimer, the term of this patent is extended or adjusted under 35 U.S.C. 154(b) by 90 days.

(21) Appl. No.: 09/742,933

(22) Filed: Dec. 20, 2000

(65) Prior Publication Data

US 2002/0074910 A1 Jun. 20, 2002

(51) Int. Cl.[7] ..... A47B 45/00
(52) U.S. Cl. ..... 312/237; 312/223.3
(58) Field of Search ..... 312/240, 223.3, 312/237, 194, 196; 5/136, 2.1, 133, 137, 138, 139, 140, 141, 142, 143, 144

(56) References Cited

U.S. PATENT DOCUMENTS

| | | | | |
|---|---|---|---|---|
| 925,397 | A | | 6/1909 | Snyder |
| 1,589,006 | A | | 6/1926 | Huddleston |
| 1,633,423 | A | | 6/1927 | Talbott |
| 2,172,605 | A | | 9/1939 | Bourn |
| 2,447,480 | A | | 8/1948 | Stubbs |
| 3,097,369 | A | | 7/1963 | Emch |
| 3,386,110 | A | | 6/1968 | Vanhentenrijk et al. |
| 3,537,769 | A | | 11/1970 | Carlo |
| 3,732,583 | A | | 5/1973 | Jones |
| 3,913,973 | A | | 10/1975 | Mintz et al. |
| 3,922,734 | A | | 12/1975 | Herrera |
| 4,070,715 | A | | 1/1978 | Reppas |
| 4,318,145 | A | | 3/1982 | Frandsen |
| 4,318,195 | A | | 3/1982 | Reppas |
| 4,345,803 | A | | 8/1982 | Heck |
| 4,476,592 | A | | 10/1984 | Reppas et al. |
| 4,538,861 | A | * | 9/1985 | Hughes, Jr. ..... 190/10 |
| 4,695,104 | A | * | 9/1987 | Lederman ..... 312/223.3 |
| 4,735,150 | A | | 4/1988 | Roberts |
| 4,828,342 | A | * | 5/1989 | Stefan ..... 108/86 |
| 5,036,558 | A | | 8/1991 | Lameka et al. |
| 5,101,523 | A | | 4/1992 | Bright |
| 5,136,737 | A | | 8/1992 | Reppas et al. |
| 5,199,773 | A | | 4/1993 | Price, Jr. et al . |
| 5,205,631 | A | | 4/1993 | Wegman et al. |
| 5,353,452 | A | | 10/1994 | Rulis |
| 5,377,951 | A | | 1/1995 | Johnson et al. |
| 5,621,930 | A | | 4/1997 | Reppas et al. |
| 5,655,823 | A | | 8/1997 | Schairbaum |
| 5,758,934 | A | | 6/1998 | Flutka et al. |
| 5,806,248 | A | * | 9/1998 | Kim ..... 312/194 |

FOREIGN PATENT DOCUMENTS

| | | | | |
|---|---|---|---|---|
| CH | 659370 | * | 1/1987 | ..... 312/223.3 |
| GB | 2172498 | * | 9/1986 | ..... 312/223.3 |
| JP | 84618 | * | 5/1985 | ..... 312/223.3 |
| JP | 197525 | * | 7/2000 | |
| WO | WO 93/25117 | | 12/1993 | |

OTHER PUBLICATIONS

Kimberly Stevens, "Bottoms Up, Murphy's Back", Dec. 26, 2000, New York Times, Section B11.
Marianne Rohrlich, "Time to Stow Those Gags", Dec. 26, 2000, New York Times, Section B11.

* cited by examiner

*Primary Examiner*—Janet M. Wilkens
(74) *Attorney, Agent, or Firm*—Harness, Dickey & Pierce, P.L.C.

(57) ABSTRACT

A convertible furniture assembly having a bed frame pivotally coupled to a base assembly. The bed frame is pivotally moveable between a upright position and a lowered position. A computer workstation is further coupled to the base assembly and adapted for supporting and stowing a computer monitor and related computer accessories even when the bed frame is in the lowered position. The convertible furniture assembly eliminates the need to provide a computer workstation separate from a bed assembly.

26 Claims, 12 Drawing Sheets

CONVERTIBLE BED WITH COMPUTER DESK

BACKGROUND AND SUMMARY OF THE INVENTION

The present invention relates generally to convertible furniture and, more particularly, to a combination convertible bed and computer workstation.

Convertible furniture has previously been provided as an expedient for saving floor space. For example, the well-known sofa bed provides a sofa in one mode and a bed frame and mattress in another mode. Other arrangements have been suggested to provide combination bed and table or desk furniture. For example, U.S. Pat. No. 4,070,715, issued to Reppas and the disclosure of which is incorporated herein, teaches a combination bed and desk furniture piece in which a bed frame and desk are mounted on a base for conjoint movement between raised and lowered positions. In the raised position, the bed frame is pivoted upright where its bedding is concealed from view and at the same time, the desk is elevated to a standard height above the floor. In the lowered position, the bed frame is pivoted to a horizontal orientation spaced above the top of the desk to provide clearance for small articles left on the desk surface. In this lowered position, the bed frame is lowered to standard bed height above the floor, which is lower than the desk. Means are provided for simultaneously moving the bed frame and desk between the raised and lowered positions without altering the horizontal alignment of the desk and its drawers with respect to the floor. This combination bed and desk furniture piece is particularly well suited for applications requiring efficient use of a space while providing a generally flat work surface. However, with the relatively recent popularity of computers, simply providing a flat working surface upon which to write may not be sufficient. That is, computers have become an everyday tool by which people work and manage their lives and, thus, must be accessible even in the most restricted living environments.

In general, computers consist of at least a computer housing or tower, a computer keyboard, and a computer monitor. As is well known, unless a computer is purchased in a laptop configuration, it is often necessary to provide a relatively large amount of space to accommodate the computer and its added peripherals.

Thus, a need has been recognized for a combination convertible bed and a computer workstation that is capable of accommodating a standard size computer housing, a computer keyboard, and a computer monitor. Accordingly, a first embodiment of the present invention incorporates a convertible bed with a computer workstation that is particularly configured to accommodate these computer peripherals, even when the convertible bed is in a lowered position. This arrangement eliminates the need to provide a computer workstation separate from a bed assembly. This arrangement is particularly useful in dormitory type environments or any other restricted living area.

According to another embodiment of the present invention, an articulated monitor shelf is provided that enables a full size computer monitor to be accommodated within the computer workstation portion even when the convertible bed is in the lowered position. This articulated monitor shelf permits the user to use a standard sized and economically priced computer monitor while still permitting the use of the convertible bed and computer workstation of the present invention.

According to yet another embodiment of the present invention, a pivoting slimline type monitor is provided in conjunction with a convertible bed and computer workstation that enables additional packaging options to be realized. The pivoting slimline monitor may be folded down over a computer keyboard to protect the monitor when the convertible bed is in a closed position and/or to provide a generally flat, continuous writing surface across the top of the computer workstation.

Additional advantages and features of the present invention will become apparent from the subsequent description and the claims taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
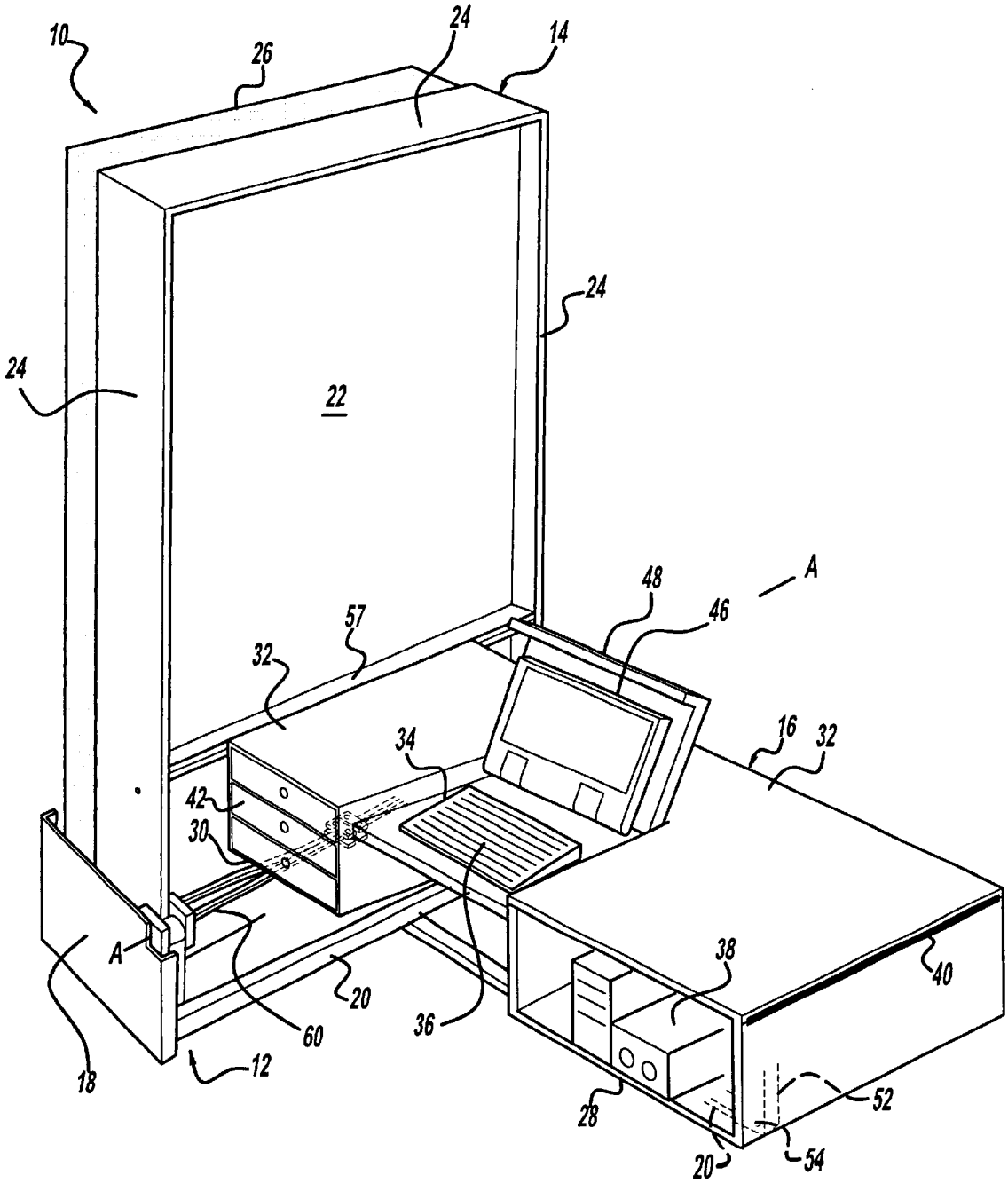
FIG. 1 is a perspective view showing a first embodiment of a combination bed and computer workstation convertible furniture employing a slimline monitor and being positioned a raised position with portions removed for clarity.
Figure 2:
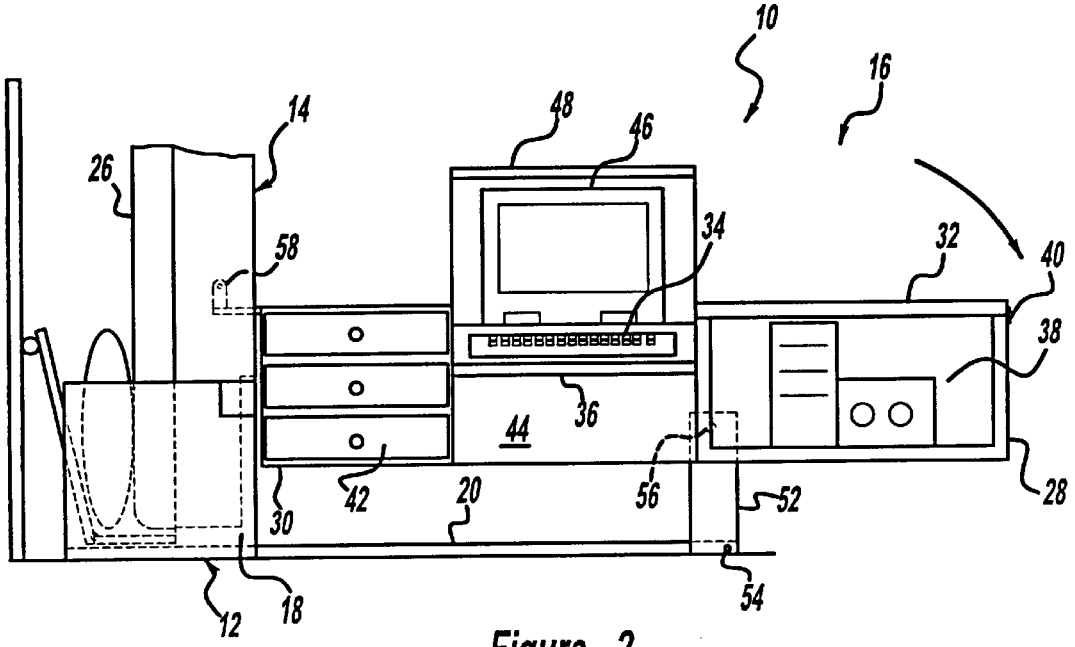
FIG. 2 is a side view showing the first embodiment of the combination bed and computer workstation convertible furniture in the raised position.
Figure 3:
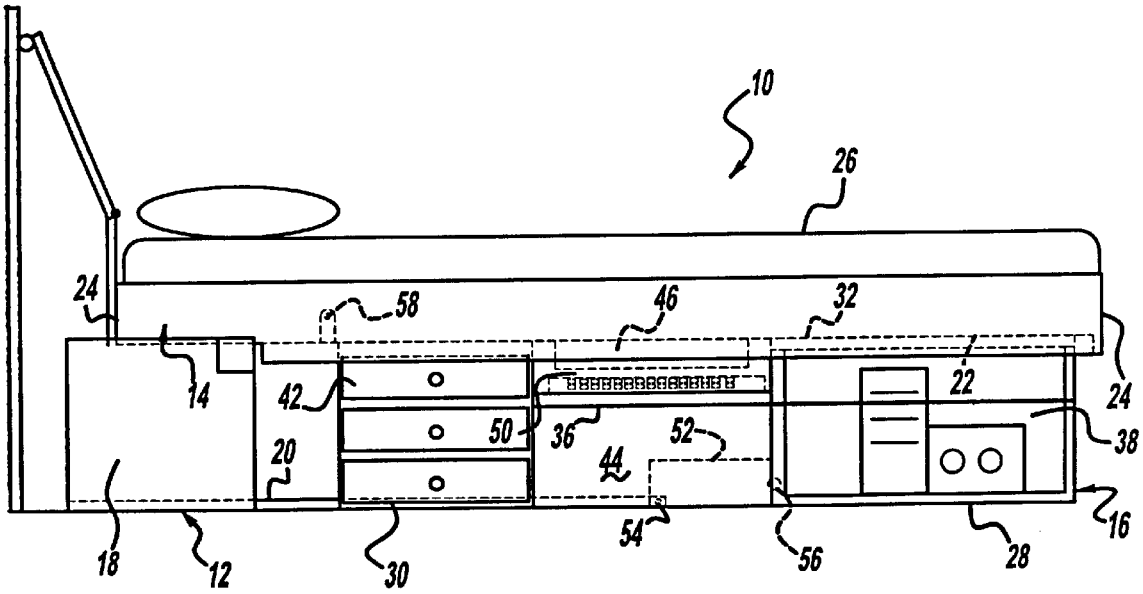
FIG. 3 is a side view showing the first embodiment of the combination bed and computer workstation convertible furniture in a lowered position.

Referring now to FIGS. 1–3, a combination convertible bed and computer workstation furniture piece according to a first embodiment of the present invention, generally indicated at 10, is provided. It should be appreciated that although various features of the present invention will be discussed in conjunction with particular embodiments, it should be understood that these various features may be combined in a number of combinations to create new and useful convertible bed and computer workstation furniture pieces. That is, the features of this invention can be used individually or in any combination. The use of any particular feature with a particular embodiment is for exemplary purposes only.

Still referring to FIGS. 1–3, furniture piece 10 includes a support frame or base assembly 12, which carries a bed frame 14 and a computer workstation 16. Base assembly 12 is adapted for standing on a floor or other generally flat support surface. Base assembly 12 includes two upright laterally spaced sidewalls 18 (only one shown) joined along a floor support 20.

As best seen in FIG. 1, bed frame 14 includes a bottom wall 22 and four sidewalls 24 that define an open rectangular enclosure for holding bedding 26. Bed frame 14 is pivotally coupled to base assembly 12 about a pivot axis A. The pivoting movement of bed frame 14 relative to base assembly 12 is most completely described in U.S. Pat. No. 5,136,737, issued to Reppas et al. and the disclosure of which is incorporated herein. Particular reference should be made to the '737 patent with regard to the torsion system for use in aiding the raising of the bed portion from the lowered position to the raised position.

Computer workstation 16 of furniture piece 10 is oriented such that its longitudinal axis extends generally perpendicular to pivot axis A. Similarly, bed frame 14 of furniture piece 10 is oriented such that its longitudinal axis extends generally perpendicular to pivot axis A. This arrangement enables the length of computer workstation 16 to be maximized due to the length of bed frame 14.

Computer workstation 16 includes a pair of pedastals 28, 30 having top surfaces defining a generally flat, horizontally disposed, desktop 32. Pedastals 28, 30 are spaced apart a sufficient width to form room for the legs of an individual seated at computer workstation 16 and furthermore to accommodate a standard size computer keyboard 34 therebetween. To this end, a computer keyboard shelf 36 extends horizontally between pedastal 28 and pedastal 30 and is downwardly offset relative to desktop 32 to provide a receptacle or cavity sufficiently sized to receive a computer keyboard and/or a slimline computer monitor. It has been found that for ergonomic reasons it is preferred that a computer keyboard be placed lower relative to the desktop height to facilitate the proper positioning of the users hands and wrists. It should be appreciated that computer keyboard 34 may be mounted to an underside of computer keyboard shelf 36 if preferred.

Pedastal 28 defines a volume 38 that is sized to receive a computer housing and to accommodate additional computer peripherals, such as a printer, disks, joy sticks, battery backups, and the like. It should be understood that pedastal 28 and, thus, volume 38 may be sized to accommodate any computer peripheral, which may be desired, such as printers, scanners, surge batteries, and the like, including the addition of adjustable shelves to support such peripherals. In order to provide access to the computer and any added peripheral, desktop 32 above pedastal 28 include a hinged connection 40 with pedastal 28 to enable convenient access to the rear section of any computer equipment set up therein.

Still referring to FIGS. 1–3, pedastal 30 is particularly sized to receive a plurality of drawers 42. However, it should be understood that pedastal 30 might be configured in any number of different arrangements according to the storage needs of the users. By way of non-limiting example, pedastal 30 may include a series of shelves with a door or simply an open volume similar to pedastal 28.

Computer workstation 16 further includes a panel 44 mounted to the back of computer workstation 16. Panel 44 is generally bounded by desktop 32, pedastal 28, and pedastal 30. Panel 44 serves to further define volume 38 and further serves to add additional rigidity and aesthetic value to computer workstation 16.

Still referring to FIGS. 1–3, computer workstation 16 is adapted to receive a computer monitor 46 mounted on a pivotable panel 48. Pivotable panel 48 is hingedly coupled to panel 44 or, alternatively, keyboard shelf 36. When pivotable panel 48 is in a raised position, computer monitor 46 is exposed for use. However, when pivotable panel 48 is in a lowered position, the backside of pivotable panel 48 is substantially coplanar with desktop 32, thereby providing a generally flat, continuous writing surface. This lowered position further encloses computer monitor 46 and computer keyboard 34 within a volume, thereby protecting and stowing computer monitor 46 and computer keyboard 34 when not in use. As best seen in FIG. 3, it is preferable that a gap 50 is present between the top surface of computer keyboard 34 and computer monitor 46 to prevent damage to computer keyboard 34 and/or computer monitor 46 when computer monitor 46 is in the lowered position.

Preferably, computer monitor 46 is a slimline type monitor, which is currently available in a plasma, liquid crystal display (LCD), or cathode ray tube (CRT) version. However, the principles of the present invention are not limited by the specific version of the slimline type monitor to be used.

Furniture piece 10 further includes a self-standing support 52 connected to floor support 20 and computer workstation 16 to facilitate the raising and lowering of computer workstation 16. Specifically, self-standing support 52 is pivotally coupled at one end to floor support 20 at pivot 54 and pivotally coupled at the other end to computer workstation 16 at pivot 56. Computer workstation 16 is further pivotally coupled to bed frame 14 via a member 57 at pivot 58. Bed frame 14, computer workstation 16, self-standing support 52, base assembly 12, and floor support 20 define a parallelogram linkage geometry which maintains a horizontal attitude of computer workstation 16 as furniture piece 10 is converted between a bed mode and a computer workstation mode. Such arrangement enables computer workstation 16 to be raised and lowered relative to the floor as bed frame 14 is pivoted about pivot axis A. A four-bar torsion system 60 (FIG. 1) stores potential energy as bed frame 14 is lowered to aid in the raising of bed frame 14 when such movement is desired.

In operation, furniture piece 10 is converted from the computer workstation mode to the bed mode according to the following operation (FIGS. 1–3). If computer workstation 16 has been used in connection with the computer, rather than as a desk having a generally flat, continuous writing surface, pivotable panel 48 is pivoted downward into the lowered position. Such pivotal movement continues until pivotable panel 48 is substantially coplanar with desktop 32. Gap 50 is maintained to prevent damage of computer keyboard 34 or computer monitor 46.

Bed frame 14 may then be lowered into the bed mode automatically or manually. Particular reference should be made to the aforementioned '195 patent for a discussion of a motorized lowering mechanism. According to a manual operation, bed frame 14 is pulled downward and, thus, caused to pivot about pivot axis A. The pivoting motion of bed frame 14 acts upon computer workstation 16 through pivot 58, thereby causing a pivoting movement of computer workstation 16 about pivots 54, 56 of self-standing support 52. It should be appreciated, however, that this pivoting movement of computer workstation 16 about pivots 54, 56 maintains computer workstation 16 in a generally horizontal orientation, thereby preventing damage to the computer components contained therein. This movement of bed frame 14 and computer workstation 16 continues until computer workstation 16 is positioned generally upon the floor or other flat surface and bed frame 14 is generally positioned on top of computer workstation 16. An opposite method is employed to convert furniture piece 10 from the bed mode to the computer workstation mode.

Figure 4:
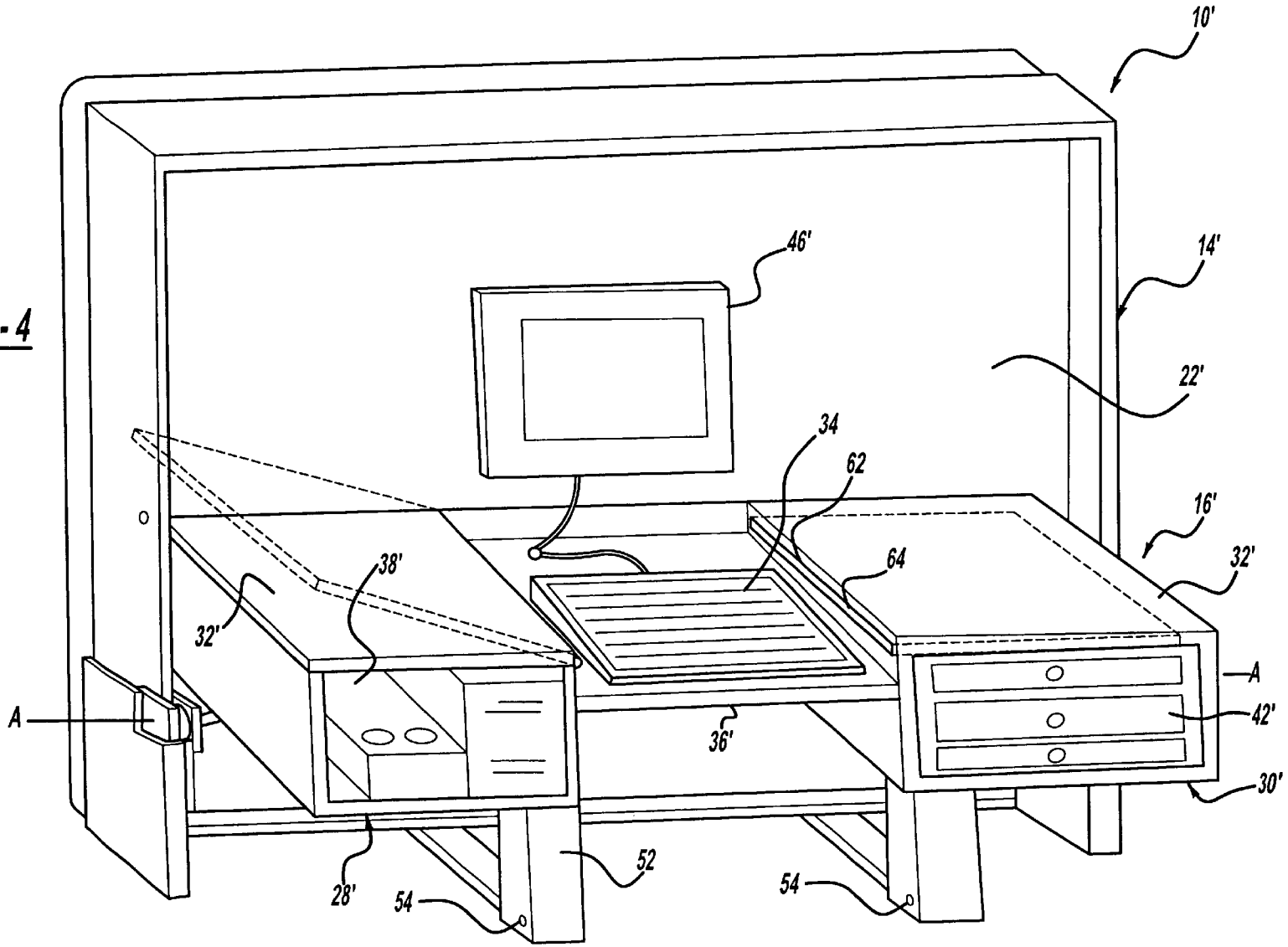
FIG. 4 is a perspective view showing a second embodiment of a combination bed and computer workstation convertible furniture employing a slimline monitor and being positioned in a raised position with portions removed for clarity.
Figure 5:
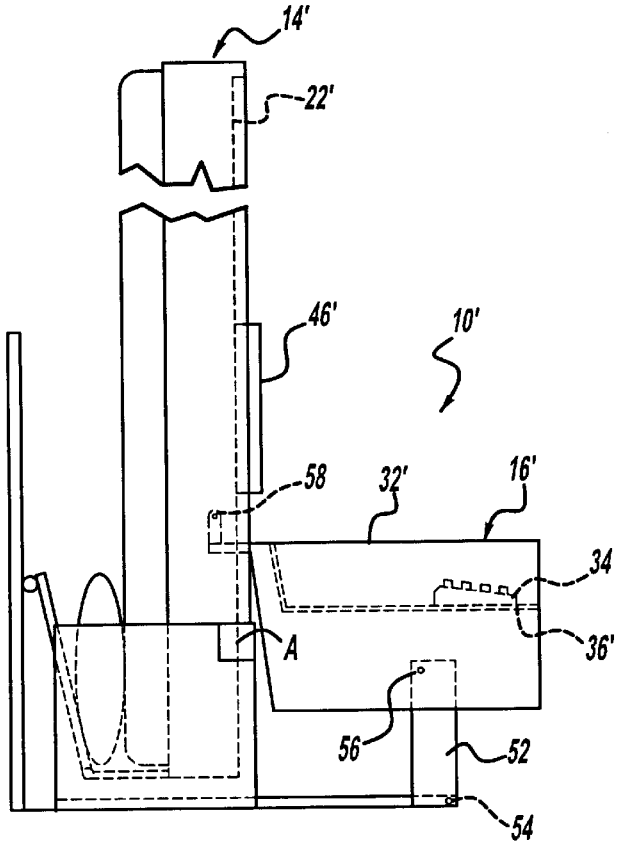
FIG. 5 is a side view showing the second embodiment of the combination bed and computer workstation convertible furniture in the raised position.
Figure 6:
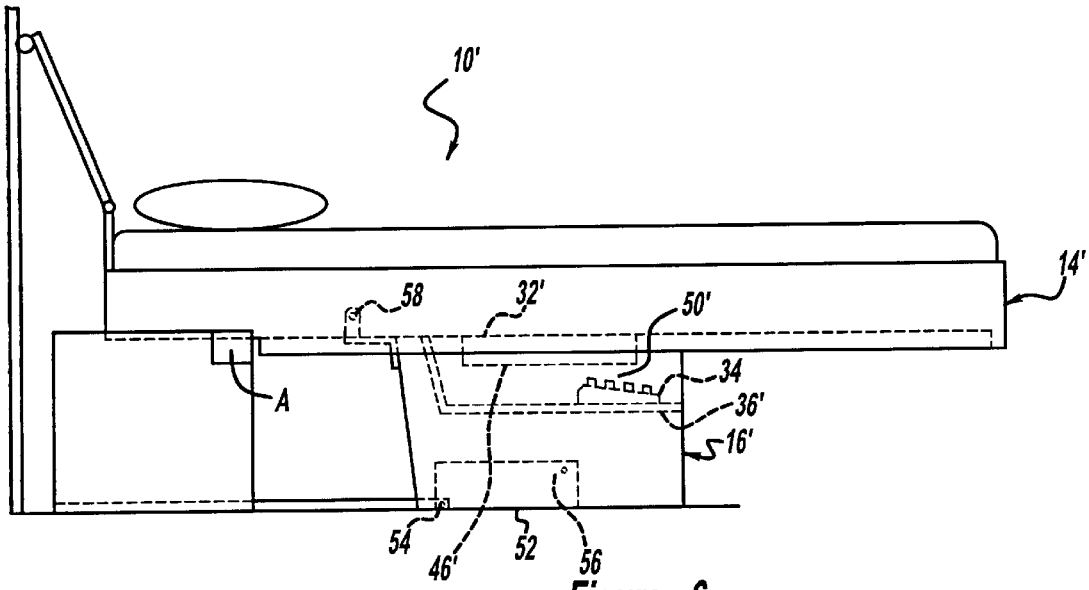
FIG. 6 is a side view showing the second embodiment of the combination bed and computer workstation convertible furniture in the lowered position.

Referring now to FIGS. 4–6, a combination convertible bed and computer workstation furniture piece according to a second embodiment of the present invention, generally indicated at 10', is provided. It should be noted that those features that are similar to those described in reference to the first embodiment of the present invention will be indicated with like numerals, therefore it is believed that further discussion relating to these similar features is not necessary.

Still referring to FIGS. 4–8, computer workstation 16' is oriented such that its longitudinal axis extends generally parallel to pivot axis A. Similarly, bed frame 14' is oriented such that its longitudinal axis extends generally parallel to pivot axis A. This arrangement enables the height of bed frame 14' to be minimized and the width of computer workstation 16' to be maximized. This arrangement is distinguished from the first embodiment of the present invention in that the longitudinal axis of bed frame 14 according to the first embodiment was generally perpendicular to pivot axis A. It should be understood that either pivoting direction might be used as required depending on bed length versus ceiling height or other space limitations.

Computer workstation 16' includes a generally flat horizontally disposed desktop 32' from which a pair of pedastals 28', 30' downwardly extend therefrom. Pedastals 28', 30' are spaced apart a sufficient width to form room for the legs of an individual seated at computer workstation 16' and furthermore to accommodate a standard size computer keyboard 34 and computer monitor therebetween.

To this end, the embodiment illustrated in FIGS. 4–6 shows a computer keyboard shelf 36' extends horizontally between pedastal 28' and pedastal 30' and is downwardly offset relative to desktop 32' to provide a receptacle or cavity sufficiently sized to receive computer keyboard 34 and/or a slimline computer monitor 46'. As described above, it has been found that for ergonomic reasons it is preferred that a computer keyboard be placed lower relative to the desktop height to facilitate the proper positioning of the user's hands and wrists.

In this particular embodiment, computer workstation 16' includes a computer monitor 46' similar to the aforementioned slimline type. However, computer monitor 46' is preferably mountable to a bottom wall 22' of bed frame 14' in a position such that as bed frame 14' is pivoted between the raised position and the lowered position, computer monitor 46' pivots into a position generally above computer keyboard 34. It is preferable that a gap 50' (FIG. 6) remains between computer monitor 46' and computer keyboard 34 to prevent damage to computer monitor 46' and/or computer keyboard 34.

Alternatively, as illustrated in FIGS. 9–15, the computer workstation of the present invention may also accommodate a standard sized computer monitor using various different storage techniques. These techniques will be described in detail below.

Pedastal 28' defines a volume 38' that is sized to receive a computer housing and to accommodate additional computer peripherals, such as a printer, disks, joy sticks, battery backups, and the like. It should be understood that pedastal 28' and, thus, volume 38' may be sized to accommodate any computer peripheral, which may be desired, such as printers, scanners, and the like, including the addition of adjustable shelves to support such peripherals. In order to provide access to the computer and any added peripheral, desktop 32' above pedastal 28' further includes a hinged connection with pedastal 28' to enable convenient access to the rear section of any computer equipment set up therein (FIG. 4).

Still referring to FIGS. 4–6, pedastal 30' is particularly sized to receive a plurality of pedastal drawers 42'. However, it should be understood that pedastal 30' may be configured in any number of different arrangements according to the storage needs of the users. By way of non-limiting example, pedastal 30' may include a series of shelves with a door or simply an open volume similar to pedastal 28'.

Additionally, a sliding or hinged writing surface 62 is mounted to one of pedastals 28', 30' and is accessible through an opening 64 formed therein when used in a sliding arrangement. Writing surface 62 is intended to be slidably drawn from opening 64 and extended across computer keyboard 34 or, alternatively, pivoted about a hinge from pedastal 30' to a position above keyboard shelf 36'. Sliding writing surface 62, when drawn across computer keyboard 34 provides a generally flat continuous writing surface across computer workstation 16' without the need to relocate computer keyboard 34.

In operation, furniture piece 10' is converted from the computer workstation mode to the bed mode according to a similar operation as described above, however, the present embodiment does not require the lowering of the computer monitor since the monitor will be lowered during the lowering operation of bed frame 14'. Moreover, the present embodiment requires less torsional resistance due to the shortened leverage arm of bed frame 14'.

Figure 7:
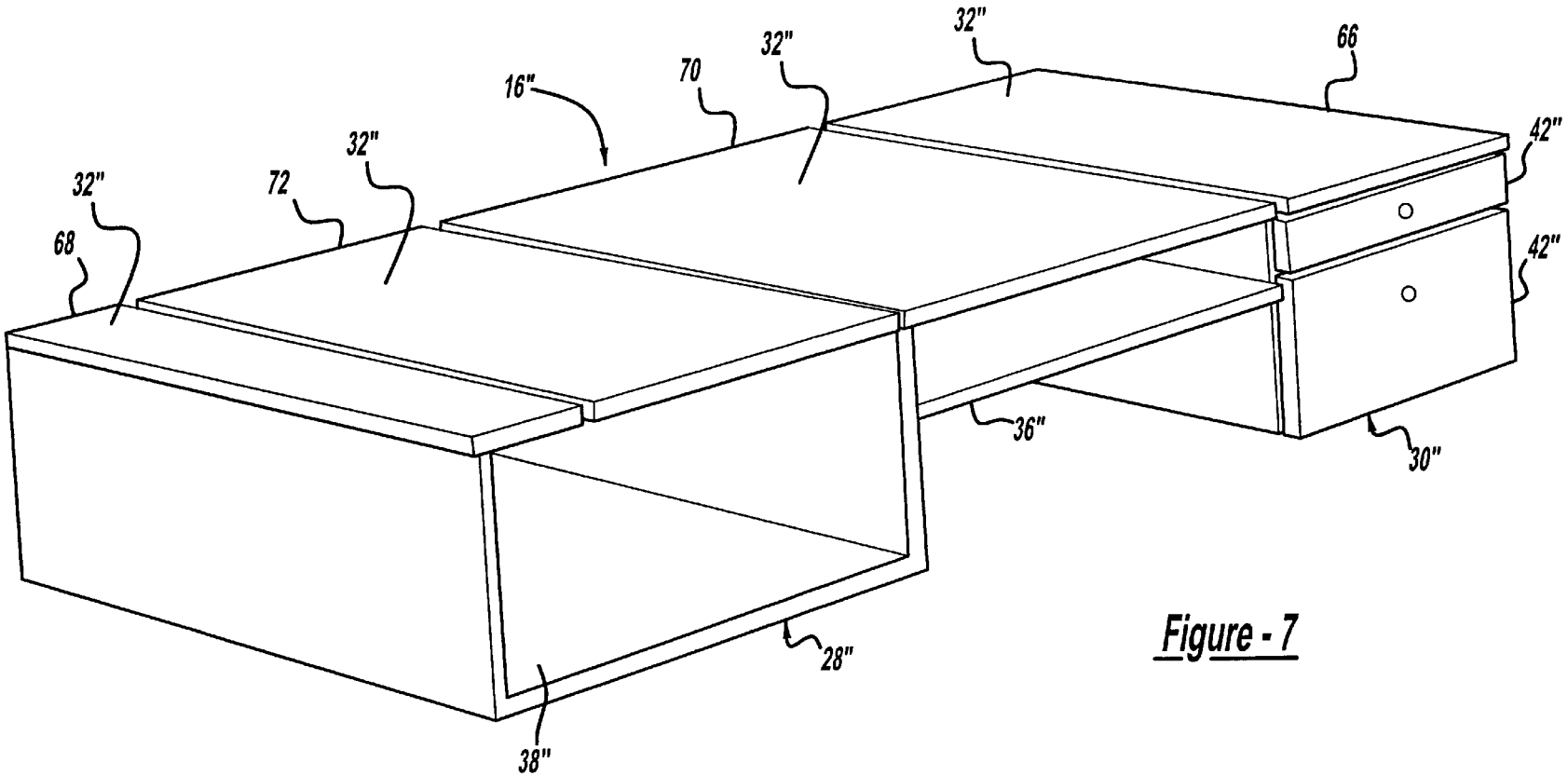
FIG. 7 is a side view showing a third embodiment of a combination bed and computer workstation convertible furniture with a desktop shown in a lowered position with portions removed for clarity.
Figure 8:
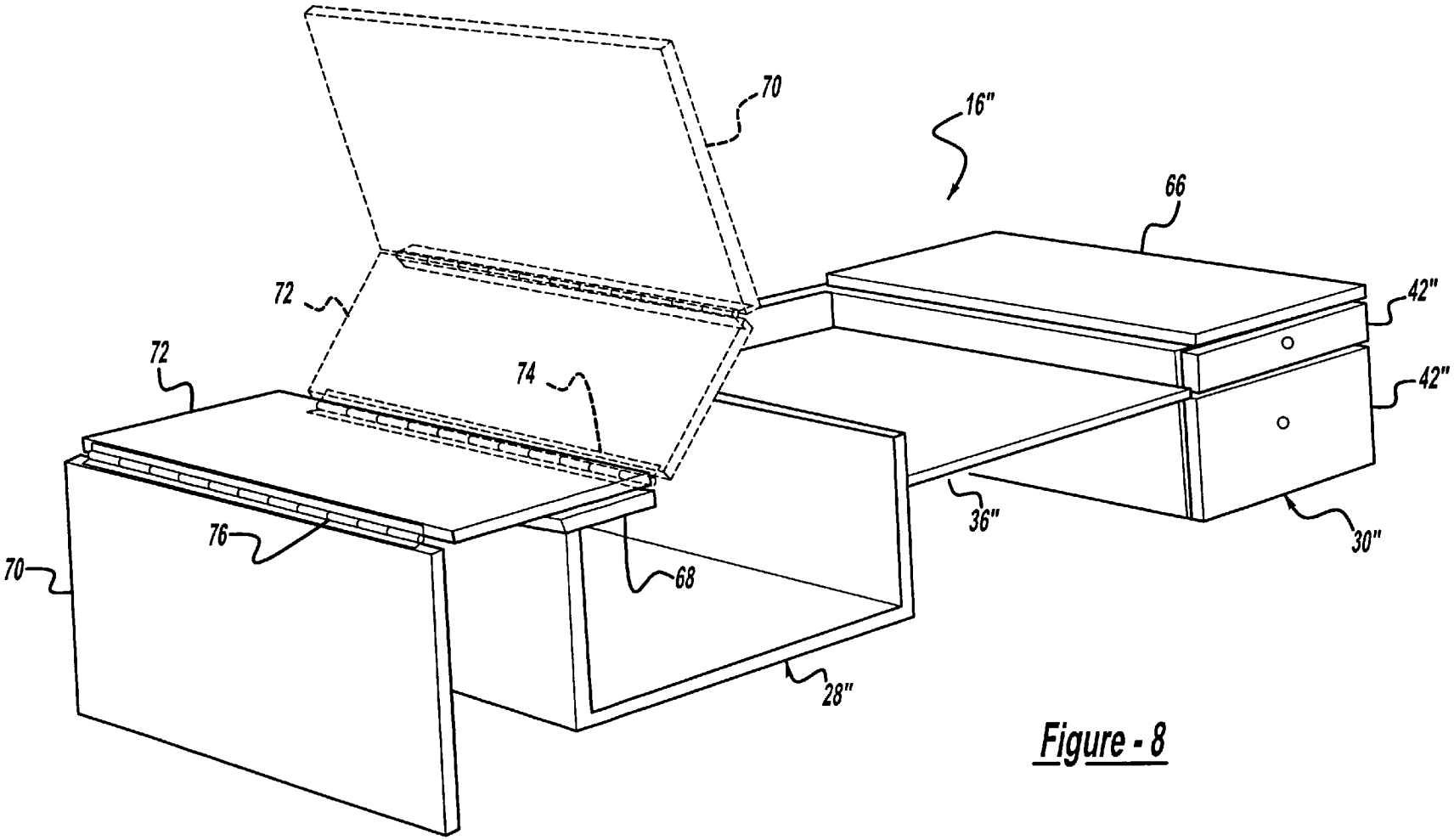
FIG. 8 is a side view showing the third embodiment of the combination bed and computer workstation convertible furniture with the desktop shown in intermediate and raised positions.

Referring now to FIGS. 7 and 8, a combination convertible bed and computer workstation furniture piece according to a third embodiment of the present invention is provided. In the interest of clarity, FIGS. 7 and 8 illustrate a computer workstation 16" for use in association with a bed frame (such as 14 and/or 14') and the associated mechanisms for raising and lowering the bed frame and computer workstation 16" as fully described above and in the incorporated references.

As best seen in FIGS. 7 and 8, computer workstation 16" includes a generally flat, horizontally disposed, desktop 32" having a pair of pedastals 28", 30" downwardly extending therefrom. Pedastal 28" and pedastal 30" are spaced apart a sufficient width to form room for the legs of an individual seated at computer workstation 16". Pedastal 28" defines a volume 38" that is sized to receive a computer housing and to accommodate additional computer peripherals, such as a printer, disks, joy sticks, battery backups, and the like. Likewise, pedastal 30" is particularly sized to receive a plurality of pedastal drawers 42".

Pedastals 28", 30" are further spaced apart a sufficient width to accommodate a standard size computer keyboard 34 and a computer monitor. To this end, a computer keyboard shelf 36" extends horizontally between pedastal 28" and pedastal 30" and is spaced downward relative to desktop 32".

Unlike the aforementioned desktops, desktop 32" includes a first stationary desktop panel 66, a second stationary desktop panel 68, a first pivoting desktop panel 70, and a second pivoting desktop panel 72. Second pivoting desktop panel 72 is pivotally coupled along one edge to second stationary desktop panel 68 via a hinge 74 and pivotally coupled along an opposing edge to first pivoting desktop panel 70 via a hinge 76. Preferably, hinges 74, 76 are piano hinges or the like for added torsional rigidity.

In operation, first pivoting desktop panel 70 may be pivoted to a position in which first pivoting desktop panel 70 lies substantially upon the top surface of second stationary desktop panel 68 and second pivoting desktop panel 72. In this position, an underside surface of first pivoting desktop panel 70 may be used as a writing surface. Alternatively, as seen in FIG. 8, first pivoting desktop panel 70 and second pivoting desktop panel 72 may be pivoted to a position in which second pivoting desktop panel 72 overlies second stationary desktop panel 68 and first pivoting desktop panel 70 extends generally downward from the hinged edge of second pivoting desktop panel 72.

As best seen in FIGS. 9–15, any of the aforementioned computer workstations may further include an articulating computer monitor shelf extending between the pair of pedastals. This articulating computer monitor shelf enables standard sized computer monitors to be articulated between a raised and operational position and a lowered and stowed position. It is understood that the present cost of slimline type monitors are cost prohibitive to many consumers and the articulating computer monitor shelf solves this problems by allowing the use of more cost efficient or superior resolution monitors.

Figure 9:
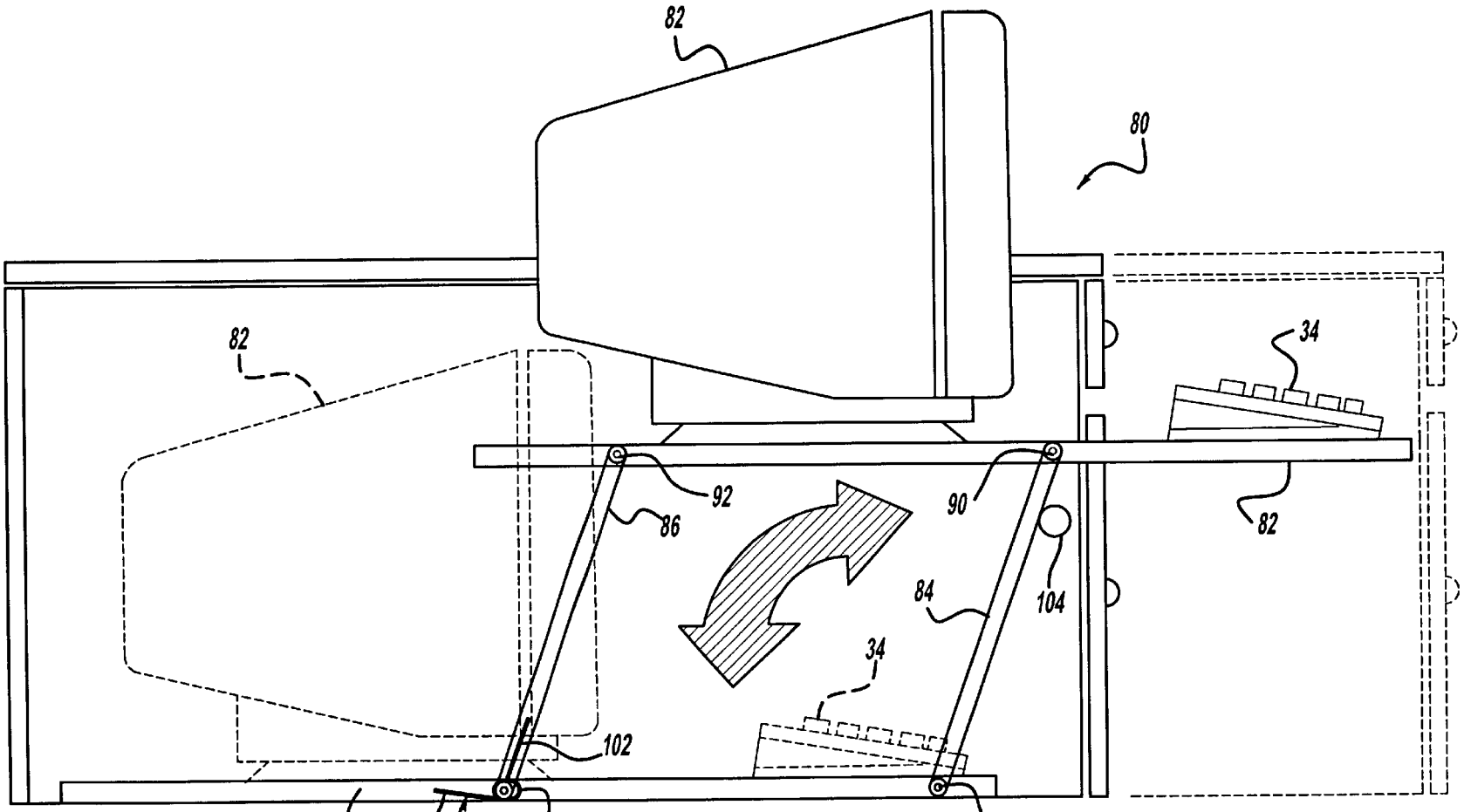
FIG. 9 is a side view showing an articulating monitor shelf employing a four bar linkage system.

Referring to FIG. 9, an articulating shelf assembly 80 is shown in a raised and operational position and also in a lowered and stowed position (in phantom). Articulating shelf assembly 80 is adapted to support a standard sized monitor 82 and a standard sized computer keyboard 34. Articulating shelf assembly 80 includes a main shelf 82, a pair of forward linkage arms 84, a pair of rearward linkage arms 86, and a biasing device 88 for aiding in the raising and lowering of main shelf 82.

Main shelf 82 is generally horizontally disposed for supporting standard sized monitor 82 and standard sized computer keyboard 34. Each of the pair of forward linkage arms 84 is pivotally coupled to main shelf 82 at pivot 90 for articulation relative thereto. Similarly, each of the pair of rearward linkage arms 86 is pivotally coupled to main shelf 82 at pivot 92 for articulation relative thereto. An opposing end of each of the pair of forward linkage arms 84 is pivotally coupled to a support panel 94 at pivot 96. Similarly, an opposing end of each of the pair of rearward linkage arms 86 is pivotally coupled to support panel 94 at pivot 98. It should be understood that support panel 94 may be manufactured integral with the computer workstation or may be manufactured separate from the computer workstation so as to be sold separately from the convertible furniture of the present invention. Main shelf 82, forward linkage arms 84, rearward linkage arms 86, and support panel 94 define a parallelogram linkage geometry which maintains a horizontal attitude of main panel 82 as articulating panel assembly 80 converted between a raised and operational mode and a lowered and stowed mode.

As illustrated in FIG. 9, biasing device 88 is a torsional spring coupled between support panel 94 and at least one of the pair of rearward linkage arms 86. Specifically, according to the embodiment illustrated in FIG. 9, biasing device 88 includes a first leg 100 generally fixed to support panel 94 and a second leg 102 fixed to at least one of the pair of rearward linkage arms 86. Alternatively, a separate biasing device 88 will be installed between support panel 94 and each of the linkage arms 84, 86 for aiding in the raising of computer monitor 82 and computer keyboard 34.

Still referring to FIG. 9, articulating shelf assembly 80 further includes a stop 104 for preventing further motion of articulating shelf assembly 80. In the raised and operational position, main shelf 82 is arranged such that linkage arms 84, 86 are inclined generally to the right in FIG. 9. Specifically, pivots 90, 92 are positioned to the right of pivots 96, 98, respectively, thereby creating an overcenter condition. This overcenter condition, in conjunction with stop 104, maintains main shelf 82 in the raised and operational position under the force of gravity.

As is particularly clear from FIG. 9, it should be noted that the pedastals may be sized such that when articulating shelf assembly 80 is in the raised and operational position, the pedastals extend a sufficient distance so that main shelf 82 and computer keyboard 34 do not extend past the pedastals. This arrangement maximizes storage space and further maximizes the size of the desktop surface. However, it is not required that the pedastals extend past the end of articulating shelf assembly 80.

In operation, articulating shelf assembly 80 is positioned from a raised and operational position to a lowered and stowed position according to the following method. A generally horizontal force is applied to main shelf 80 to rotate linkage arms 84, 86 in a counter clockwise direction. Force is continually applied to main shelf 80 until the overcenter condition is overcome at which time gravity will aid in the lowering of main shelf 80. Preferably, biasing device 88 is sized such that as main shelf 80 is lowered, a sufficient amount of biasing force is applied to at least one rearward linkage 86 to minimize the force necessary to be applied by the user during the lowering motion. However, it is anticipated that a dampening member, such as a pneumatic actuator, may be used to aid in the lowering of main panel 82

Figure 10:
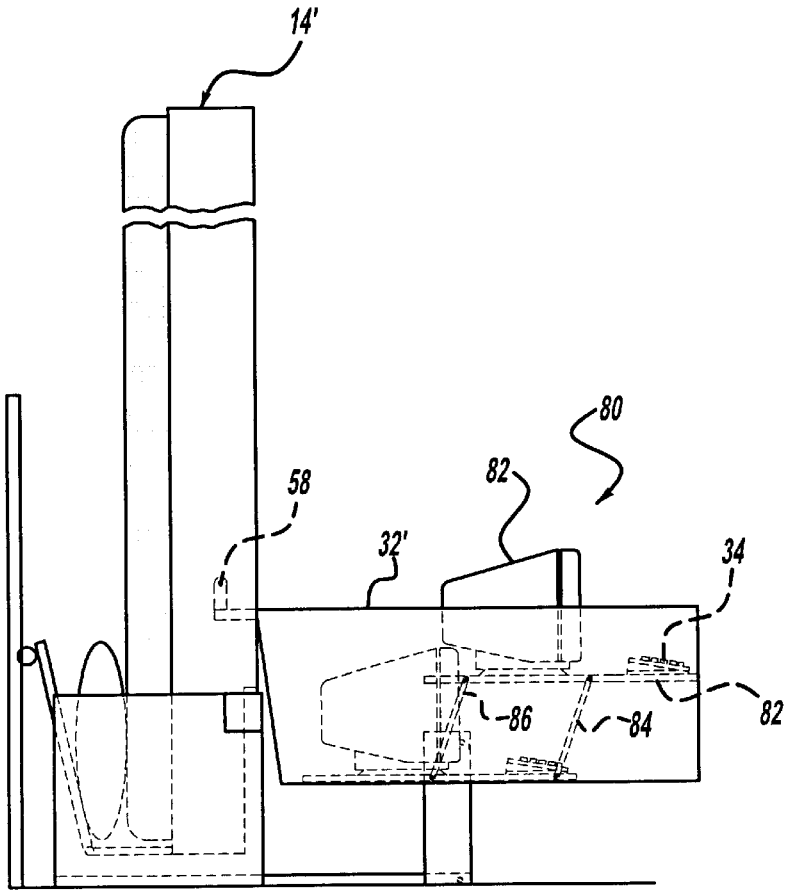
FIG. 10 is a side view showing the articulating monitor shelf of FIG. 9 incorporated into the second embodiment of the combination bed and computer workstation convertible furniture in the raised position.
Figure 11:
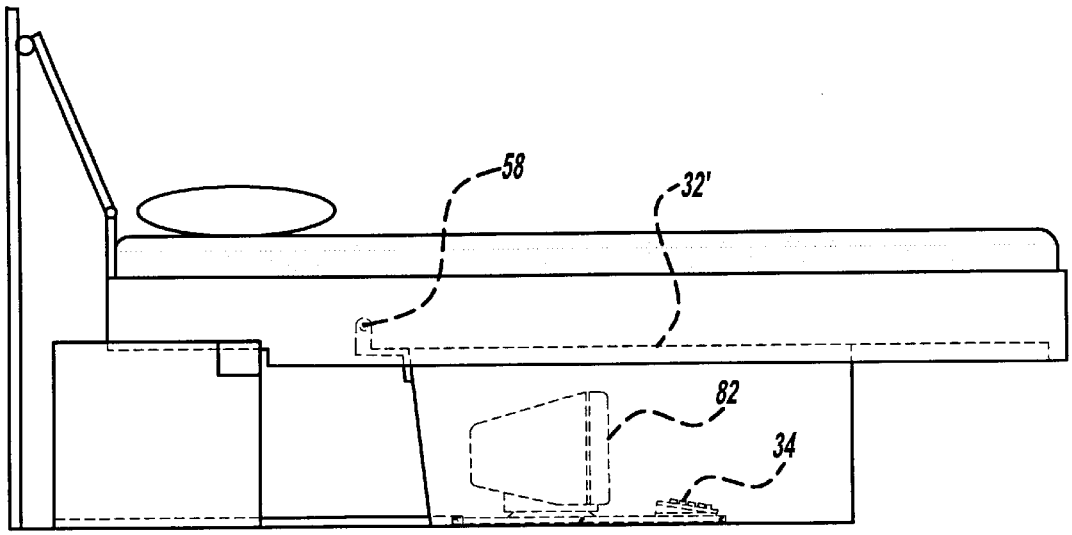
FIG. 11 is a side view showing the articulating monitor shelf of FIG. 9 incorporated into the second embodiment of the combination bed and computer workstation convertible furniture in the lowered position.
Figure 12:
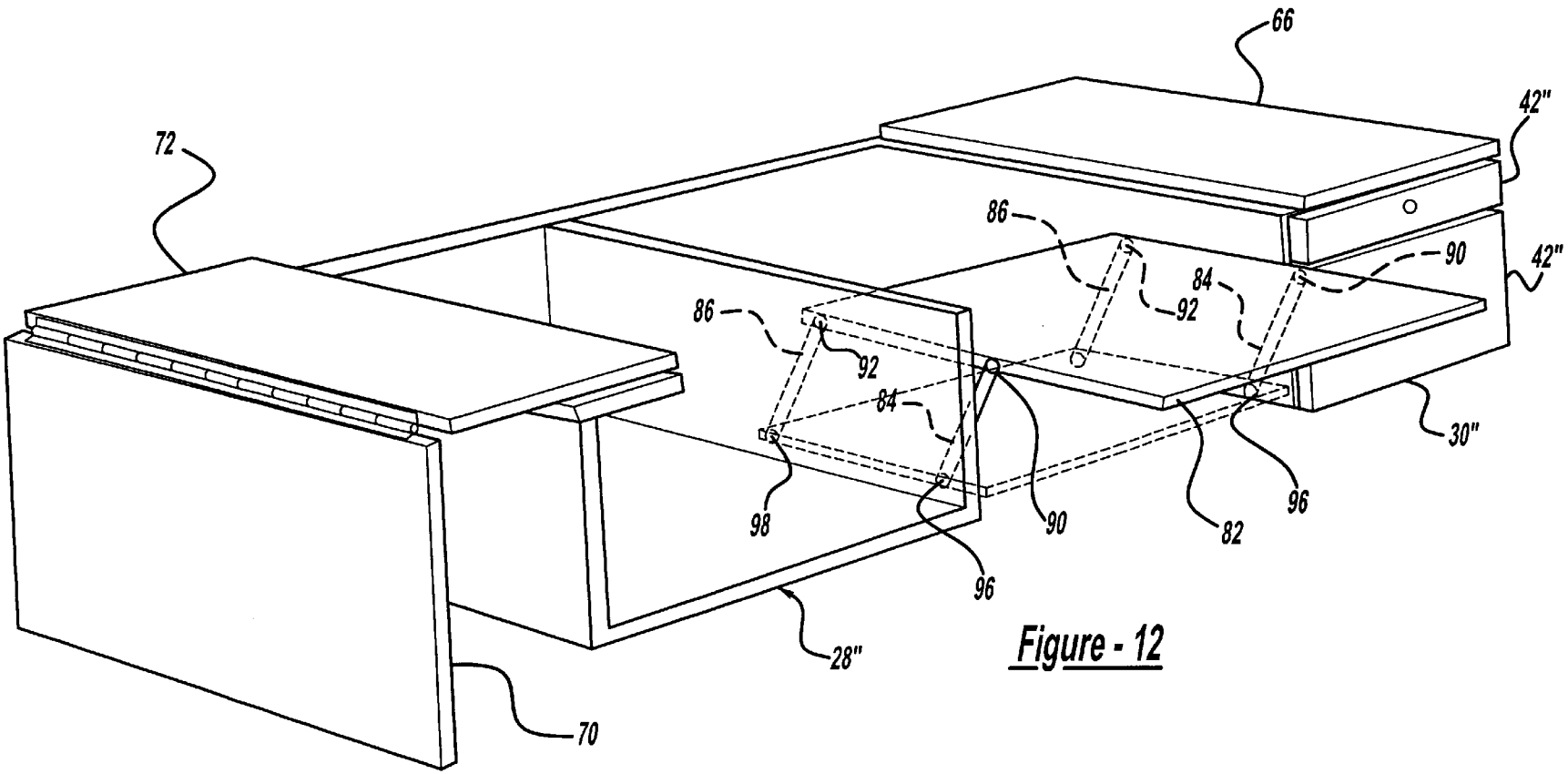
FIG. 12 is a perspective view showing the articulating monitor shelf of FIG. 9 incorporated into the third embodiment of the combination bed and computer workstation convertible furniture.

As illustrated in FIGS. 10–12, articulating shelf assembly 80 is thus capable of raising and lowering a standard sized computer monitor and standard sized computer keyboard.

Figure 13:
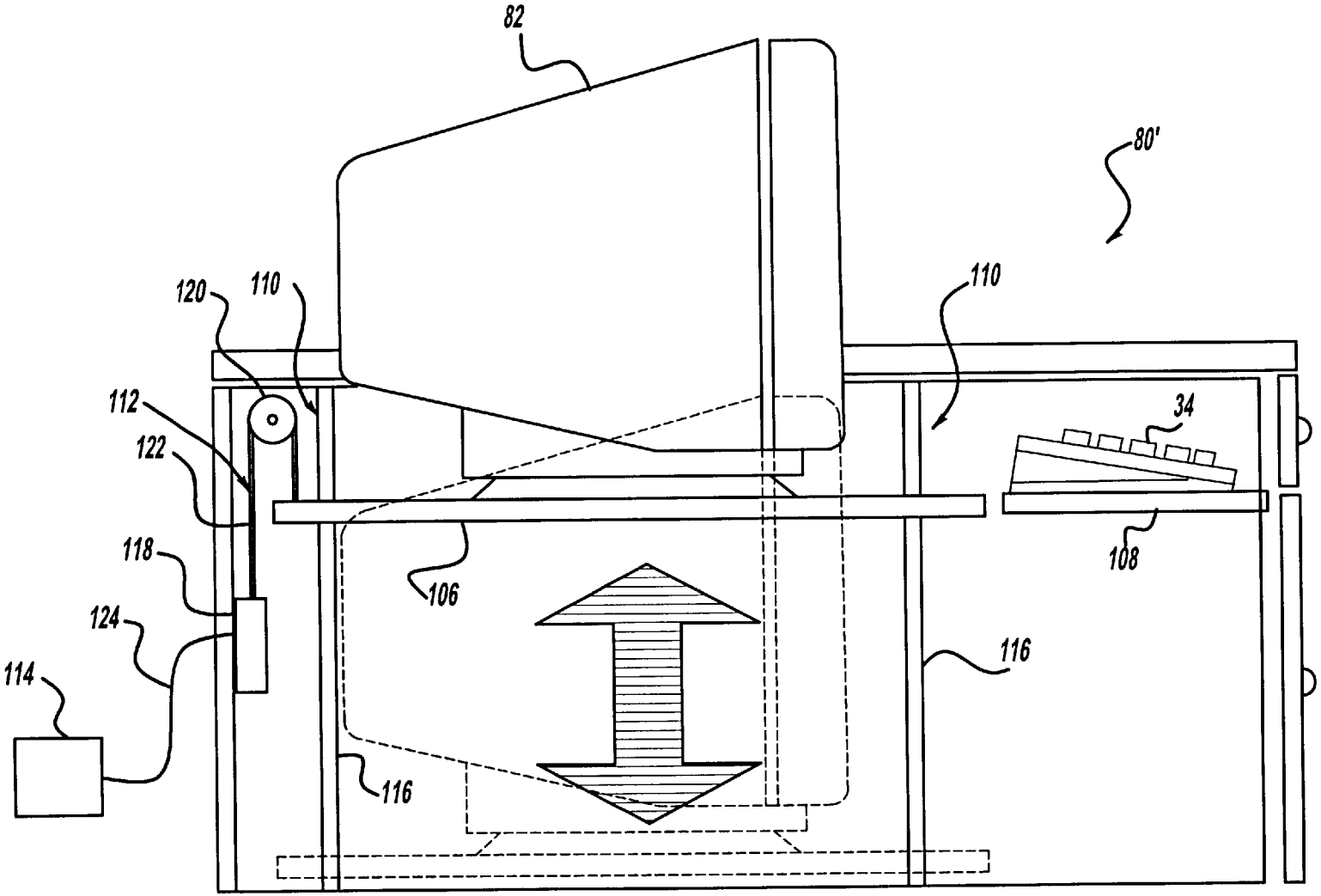
FIG. 13 is a side view showing an articulating monitor shelf employing a cable and pulley system.

Referring now to FIG. 13, an articulating shelf assembly 80' is shown having an articulating computer monitor shelf 106 for supporting standard sized computer monitor 82, a fixed computer keyboard shelf 108 for supporting standard sized computer keyboard 34, at least a pair of track and roller assemblies 110, an actuating mechanism 112, and a controller 114. Fixed computer keyboard shelf 108 is mounted between the pair of pedastals in a fixed position. However, articulating computer monitor shelf 106 is adapted for generally vertical translation between a raised and operational position and a lowered and stowed position. To this end, articulating computer monitor shelf 106 includes at least a pair of track and roller assemblies 110. Specifically, track and roller assemblies 110 each include a track 116 vertically mounted to a side of at least one of the pedastals. A roller (not shown) is fixed to articulating computer monitor shelf 106 and is further disposed within track 116 for sliding movement therein. By way of non-limiting example, track and roller assembly 110 may be a drawer slide assembly. Preferably, track and roller assembly 110 is provided generally at the corners of articulating computer monitor shelf 106 for maintaining proper support of computer monitor shelf 106. Actuating mechanism 112 includes a motor 118, a pulley 120, and a cable 122. Motor 118 is controlled by controller 114 via line 124. Cable 122 is coupled between motor 118 and articulating computer monitor shelf 106 about pulley 120. Motor 118 is operable to incrementally release cable 122, thereby effecting either a lowering or a raising of articulating computer monitor shelf. It should be understood that additional actuating mechanisms may be used depending on the amount of packaging space available and the anticipated weight of the computer monitor.

Figure 14:
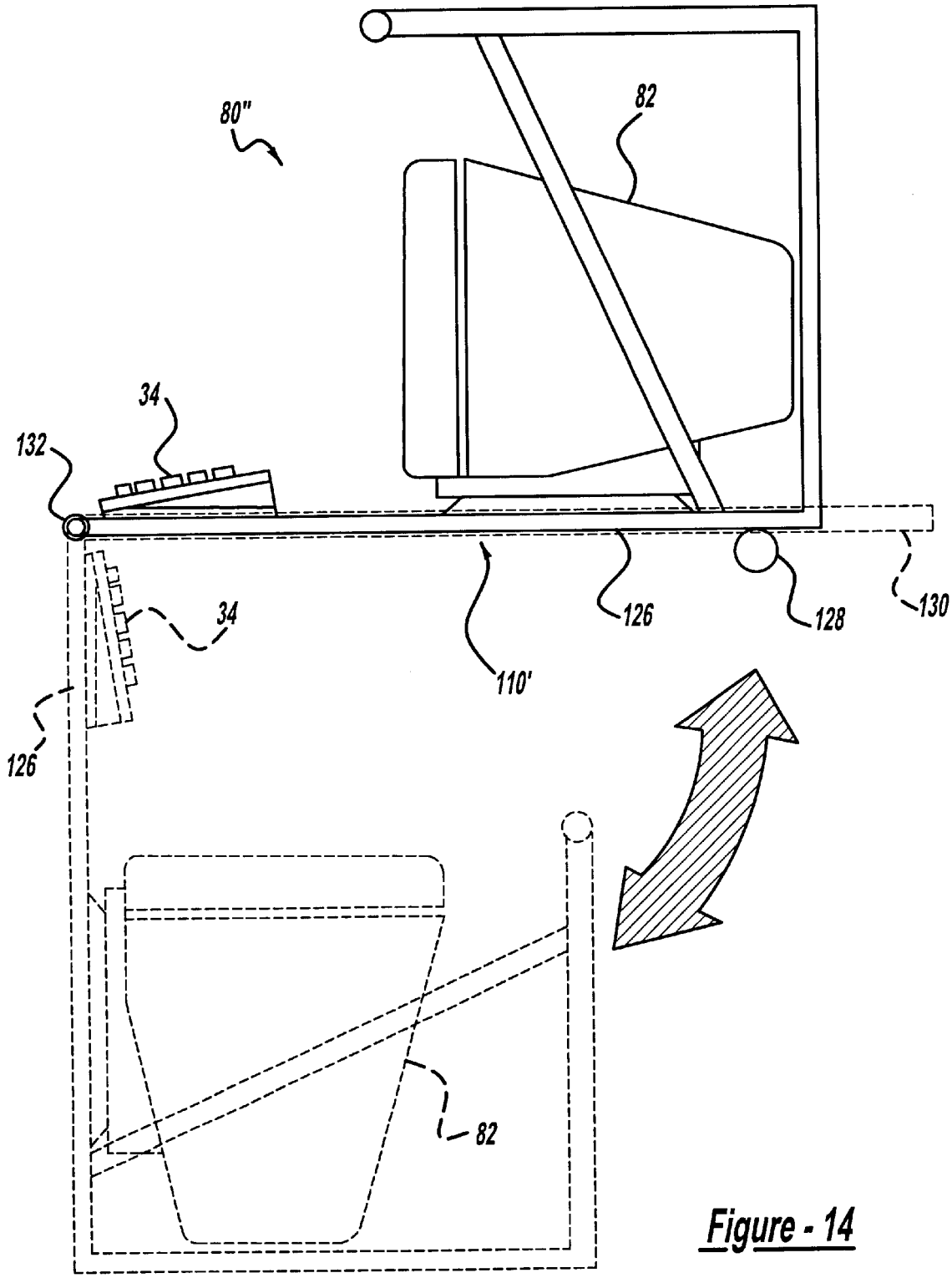
FIG. 14 side view showing an articulating monitor shelf employing a swing down/slide system.
Figure 15:
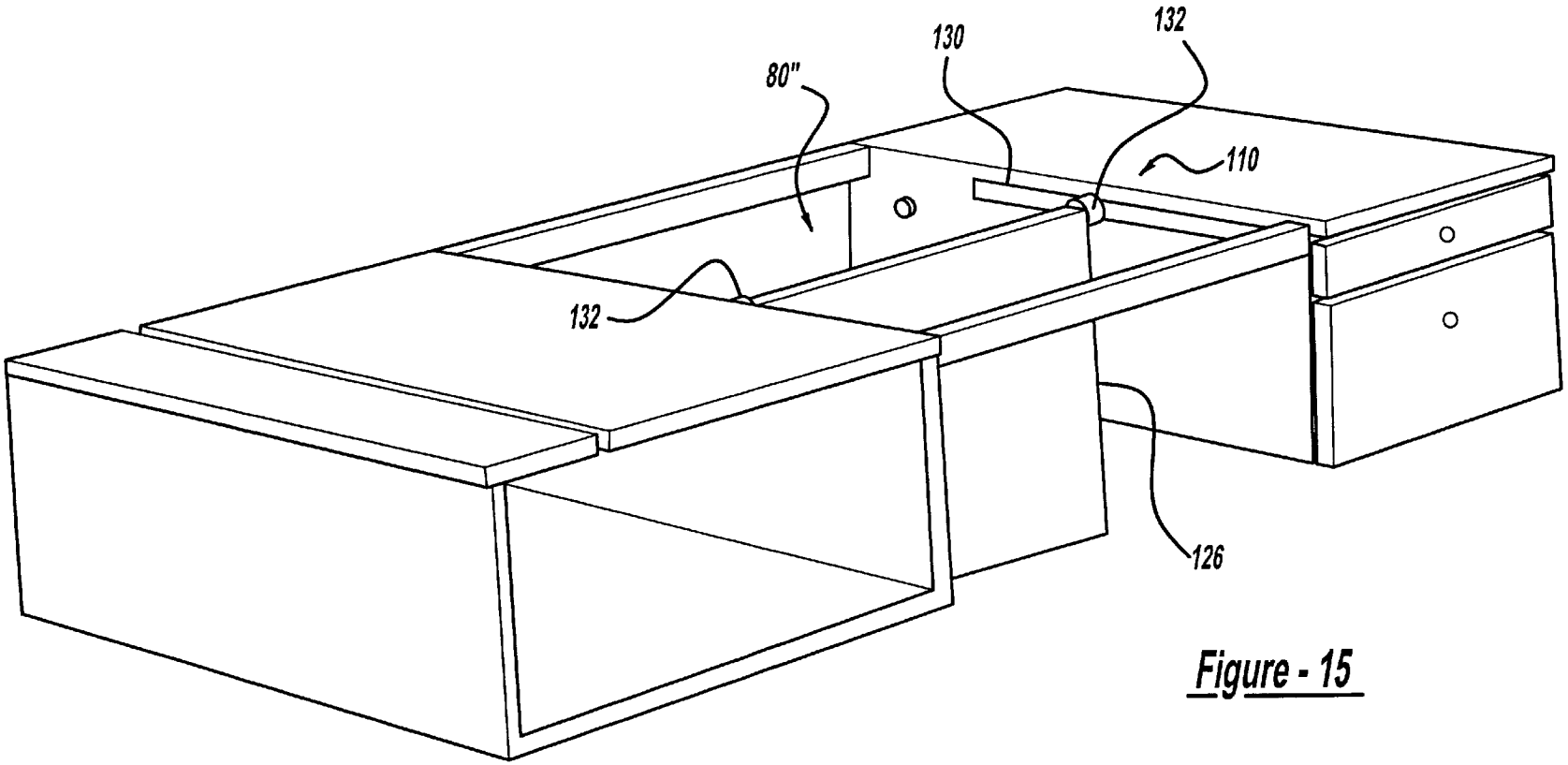
FIG. 15 is a perspective view showing the articulating monitor shelf of FIG. 14 incorporated into the third embodiment of the combination bed and computer workstation convertible furniture.

Referring now to FIGS. 14 and 15, an articulating shelf assembly 80" is shown schematically for supporting a standard sized computer monitor 82 and a standard sized computer keyboard 34. Articulating shelf assembly 80" includes a main shelf 126 and a pair of pivoting track and roller assemblies 110'. As best seen in FIG. 14, computer monitor 82 and computer keyboard 34 are each mounted to main shelf 126 to prevent separation of computer monitor 82 and computer keyboard 34 during articulating of main shelf 126.

Articulating shelf assembly 80" further includes a removable stop 128 mounted to the computer workstation. Removable stop 128 is selectively extended to provide a support upon which main shelf 126 may rest when main shelf 126 is in the raised and operational position. Removable stop 128 may be any one of a number of designs, such as a spring loaded pin or a slidable rod extending between opposing pedastals.

Track and roller assemblies 110' each include a track 130 horizontally mounted to a side of opposing pedastals. A roller 132 is mounted to main shelf 126 and is further disposed within track 130 for sliding movement therein. By way of non-limiting example, track and roller assembly 110' may be a drawer slide assembly. By selectively removing stop 128, main panel 126 is allowed to swing downward into a generally vertical position. That is, the bearing action of rollers 132 enables main panel 126 to freely rotate once stop 126 is removed. Once main panel 126 is released into the generally vertical position, articulating shelf assembly 80" may be slid along tracks 130. As best seen in FIG. 15, articulating shelf assembly 80" may be slid forward or rearward to provide knee space on either side of the computer workstation.

As can be appreciated from the foregoing discussion, the combination convertible bed and computer workstation of the present invention eliminates the need to provide a computer workstation separate from a bed assembly, thereby providing improved use of the available living space. Moreover, the combination bed and computer workstation of the present invention provides a means of accommodating a standard sized computer monitor and peripherals simply and conveniently. That is, the combination bed and computer workstations provide a novel method of accommodating a computer housing, keyboard, monitor, and additional computer accessories in a limited living environment.

While the preferred embodiments have been disclosed herein, it should be appreciated that other variations may be employed within the scope of the present invention. The description of the invention is exemplary in nature and, thus, variations that do not depart from the gist of the invention are intended to be within the scope of the invention. Such variations are not to be regarded as a departure from the spirit and scope of the invention.

What is claimed is:

1. A convertible furniture assembly comprising:

a base assembly;

an upper platform pivotally coupled to said base assembly for supporting a bedding component, said upper platform being moveable between a raised position and a lowered position;

a lower platform coupled to said base assembly, said lower platform having a desk surface; and a computer monitor mounted on said upper platform, said computer monitor being positionable between an operating position when said upper platform is in said raised position and a stowed position when said upper platform is in said lowered position.

2. The convertible furniture assembly according to claim 1, further comprising:

a self-standing support pivotally coupled between said base assembly and said lower platform, said upper platform being pivotally coupled with said lower platform in parallelogram linkage geometry with said self-standing support and said base assembly for maintaining a horizontal orientation of said lower platform throughout the raising and lowering of said upper platform.

3. The convertible furniture assembly according to claim 1 wherein said computer monitor is a slimline type.

4. The convertible furniture assembly according to claim 1, further comprising:

a panel slidably coupled to said lower platform, said panel being positionable in an extended position wherein said panel is substantially coplanar with said desktop surface.

5. The convertible furniture assembly according to claim 1, further comprising:

a desktop panel pivotally coupled to said lower platform, said desktop panel being positionable between a first position wherein said desktop panel overlays an opening in said lower platform and a second position wherein said desktop panel provides a writing surface generally adjacent said opening in said lower platform.

6. The convertible furniture assembly according to claim 1, further comprising a keyboard shelf slidably coupled to said lower platform for supporting a computer keyboard thereon.

7. The convertible furniture assembly according to claim 1 wherein said upper platform is a bed frame.

8. The convertible furniture assembly according to claim 1 wherein said lower platform is a computer workstation.

9. A convertible furniture assembly comprising:

a base assembly;

an upper platform pivotally coupled to said base assembly for supporting a bedding component, said upper platform being moveable between a upright position and a lowered position;

a lower platform coupled to said base assembly, said lower platform having a desk surface and a computer component cavity, said computer component cavity being sized to receive a computer monitor therein when said upper platform is in said lowered position; and an articulating monitor shelf pivotally coupled within said computer component cavity, said articulating monitor shelf having a horizontally disposed lower member, a horizontally disposed upper member supporting said computer monitor, and a pair of links pivotally interconnecting said lower member and said upper member to form a parallelogram, said articulating monitor shelf being positionable in a raised position and a stowed position.

10. The convertible furniture assembly according to claim 9, further comprising:

a self-standing support assembly pivotally coupled between said base assembly and said lower platform, said upper platform being pivotally coupled with said lower platform in parallelogram linkage geometry with said self-standing support and said base assembly for maintaining a horizontal orientation of said lower platform throughout the raising and lowering of said upper platform.

11. The convertible furniture assembly according to claim 9, further comprising:

a panel slidably coupled to said lower platform, said panel being positionable in an extended position wherein said panel substantially spans said computer component cavity and is substantially coplanar with said desktop surface.

12. The convertible furniture assembly according to claim 9, further comprising:

a desktop panel pivotally coupled to said lower platform, said desktop panel being positionable between a first position wherein said desktop panel overlays said computer component cavity and a second position wherein said desktop panel provides a writing surface generally adjacent said computer component cavity.

13. The convertible furniture assembly according to claim 9, further comprising a keyboard shelf mounted to said lower platform.

14. The convertible furniture assembly according to claim 13 wherein said keyboard shelf is slidably mounted within said computer component cavity of said lower platform.

15. The convertible furniture assembly according to claim 9 wherein said upper platform is a bed frame.

16. The convertible furniture assembly according to claim 9 wherein said lower platform is a computer workstation.

17. The convertible furniture assembly according to claim 9 wherein said movement of said articulating monitor shelf between said stowed position and said raised position progressively positions said computer monitor closer to a user for viewing.

18. The convertible furniture assembly according to claim 9 wherein said horizontally disposed lower member is formed integral with said lower platform.

19. The convertible furniture assembly according to claim 9 wherein said articulating monitor shelf defines an over-center condition at a position between said raised position and said stowed position.

20. The convertible furniture assembly according to claim 9, further comprising:

a spring biasing said articulating monitor shelf into said raised position.

21. A convertible furniture assembly for accommodating a computer, said computer having a computer monitor, computer keyboard, and a central processing unit, said convertible furniture assembly comprising:

a base structure;

a bed frame pivotally coupled to said base structure, said bed frame being moveable between a raised position and a sleeping position;

a computer workstation pivotally coupled to said bed frame, said computer workstation having a desk surface and a computer component receptacle, said computer component receptacle being spaced below said desk surface, said computer component receptacle being sized to accommodate a computer keyboard and computer monitor therein when said bed frame is in said sleeping position;

a support pivotally coupled between said base structure and said computer workstation, said bed frame, said computer workstation, said support and said base structure forming a parallelogram linkage for maintaining a horizontal orientation of said computer workstation between said raised position and said sleeping position of said bed frame; and a slidable monitor shelf mechanism movably coupled generally within said computer component receptacle and positionable in a raised position and a stowed position, said slidable monitor shelf mechanism having a support shelf supporting said computer monitor, a least a pair of guide members extending from said support shelf engaging respective tracks disposed within said computer component receptacle, and a power actuating mechanism operably driving said support shelf between said raised position and said stowed position.

22. The convertible furniture assembly according to claim 21, further comprising:

a panel slidably coupled to said computer workstation, said panel being positionable in an extended position wherein said panel substantially spans said computer component receptacle and is substantially coplanar with said desktop surface.

23. The convertible furniture assembly according to claim 21, further comprising:

a desktop panel pivotally coupled to said computer workstation, said desktop panel being positionable between a first position wherein said desktop panel overlays said computer component receptacle and a second position wherein said desktop panel provides a writing surface generally adjacent said computer component receptacle.

24. The convertible furniture assembly according to claim 21, further comprising a keyboard shelf slidably coupled to said computer workstation for supporting a computer keyboard thereon.

25. The convertible furniture assembly according to claim 21 wherein said power actuating mechanism comprises a motor, a cable, and a controller, said cable being coupled between said motor and said support shelf such that said support shelf is moved between said raised position and said stowed position in response to actuation of said motor by said controller.

26. The convertible furniture assembly according to claim 21 wherein a direction of said movement of said support shelf between said raised position and said stowed position is solely vertical.

* * * * *